US005523827A

United States Patent [19]

Snelling et al.

[11] Patent Number: 5,523,827

[45] Date of Patent: Jun. 4, 1996

[54] PIEZO ACTIVE DONOR ROLL (PAR) FOR STORE DEVELOPMENT

[75] Inventors: Christopher Snelling, Penfield; Dale R. Mashtare, Macedon, both of N.Y.

[73] Assignee: Xerox Corporation, Stamford, Conn.

[21] Appl. No.: 356,020

[22] Filed: Dec. 14, 1994

[51] Int. Cl.[6] ..... G03G 15/06

[52] U.S. Cl. ..... 355/259; 355/261; 355/262; 355/265; 118/647; 118/651

[58] Field of Search ..... 355/259, 245, 355/261, 262, 263, 265; 118/653, 656, 647, 648, 649, 650, 651; 347/55

[56] References Cited

U.S. PATENT DOCUMENTS

| | | | |
|---|---|---|---|
| 4,078,929 | 3/1978 | Gundlach | 96/1.2 |
| 4,546,722 | 10/1985 | Toda et al. | 118/657 |
| 4,568,955 | 2/1986 | Hosoya et al. | 346/153.1 |
| 4,760,422 | 7/1988 | Seimiya et al. | 118/656 X |
| 4,794,878 | 1/1989 | Connors et al. | 118/653 |
| 4,833,503 | 5/1989 | Snelling | 355/259 |
| 4,987,456 | 1/1991 | Snelling et al. | 355/273 |
| 5,010,367 | 4/1991 | Hays | 355/247 |
| 5,012,299 | 4/1991 | Sawamura et al. | 355/326 R |
| 5,194,905 | 3/1993 | Brewington | 355/326 R |
| 5,255,059 | 10/1993 | Kai et al. | 355/261 |
| 5,305,070 | 4/1994 | Snelling | 118/657 |

FOREIGN PATENT DOCUMENTS

| | | |
|---|---|---|
| 61-176960 | 8/1986 | Japan . |
| 4-346373 | 12/1992 | Japan . |

*Primary Examiner*—Matthew S. Smith

[57] ABSTRACT

A development system which uses a donor roll structure including a piezoelectric layer or film for liberating toner particles from its surface. The donor roll is provided with a plurality of electrodes spaced about a circumference of the roll. An electrical bias is used to apply a voltage to electrodes as they pass through a developer nip or zone intermediate the donor roll and an imaging member containing latent electrostatic images. The voltage is applied to each electrode and another continuous electrode which together sandwich the piezoelectric layer therebetween such that a voltage is applied across a portion of the piezoelectric layer in the nip thereby causing acoustic excitation of the portion of the layer only in the nip.

10 Claims, 2 Drawing Sheets

PIEZO ACTIVE DONOR ROLL (PAR) FOR STORE DEVELOPMENT

BACKGROUND OF THE INVENTION

The invention relates to electronic copying/printing systems and more particularly to a non-interactive development system for presenting toner particles to latent electrostatic images for rendering the images visible.

The invention can be utilized in the art of xerography or in the printing arts. In the practice of conventional xerography, it is the general procedure to form electrostatic latent images on a xerographic surface by first uniformly charging a photoreceptor. The photoreceptor comprises a charge retentive surface. The charge is selectively dissipated in accordance with a pattern of activating radiation corresponding to original images. The selective dissipation of the charge leaves a latent charge pattern on the imaging surface corresponding to the areas not exposed by radiation. The areas of charge dissipated on the photoreceptor correspond to residual or background voltage levels. Thus, the photoreceptor may, in a digital printer, contain two voltage levels while in a light/lens machine there is a vast array of levels.

This latent charge pattern is rendered visible by developing it with toner. The toner is generally a colored powder which adheres to the charge pattern by electrostatic attraction.

The developed image is then fixed to the imaging surface or is transferred to a receiving substrate such as plain paper to which it is fixed by suitable fusing techniques.

Conventional xerographic imaging techniques which were directed to monochrome image formation have been extended to the creation of color images including highlight color images. In one method of highlight color imaging, the images are created using a raster output scanner to form tri-level images including a pair of image areas and a background area intermediate the two image areas.

The concept of tri-level, highlight color xerography is described in U.S. Pat. No. 4,078,929 issued in the name of Gundlach. The patent to Gundlach teaches the use of tri-level xerography as a means to achieve single-pass highlight color imaging. As disclosed therein the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

In highlight color xerography as taught by Gundlach, the xerographic contrast on the charge retentive surface or photoreceptor is divided into three levels, rather than two levels as in the case in conventional xerography. The photoreceptor is charged, typically to −900 volts. It is exposed imagewise, such that one image corresponding to charged image areas (which are subsequently developed by charged-area development, i.e. CAD) stays at the full photoreceptor potential ($V_{CAD}$ or $V_{ddp}$). $V_{ddp}$ is the voltage on the photoreceptor due to the loss of voltage while the photoreceptor remains charged in the absence of light, otherwise known as dark decay. The other image is exposed to discharge the photoreceptor to its residual potential, i.e. $V_{DAD}$ or $V_c$ (typically −100 volts) which corresponds to discharged area images that are subsequently developed by discharged-area development (DAD) and the background area is exposed such as to reduce the photoreceptor potential to halfway between the $V_{CAD}$ and $V_{DAD}$ potentials, (typically −500 volts) and is referred to as $V_{white}$ or $V_w$. The CAD developer is typically biased about 100 volts closer to $V_{CAD}$ than $V_{white}$ (about −600 volts), and the DAD developer system is biased about −100 volts closer to $V_{DAD}$ than $V_{white}$ (about 400 volts). As will be appreciated, the toners used in a system such as described above need not comprise different colors but may have other distinguishing characteristics. For, example, both toners could be black but one toner may be magnetic and the other non-magnetic.

The above described tri-level imaging process is utilized in the 4850™ printer. This printer is capable of creating images with black toner and one of several highlighting colors.

Following is a discussion of prior art, incorporated herein by reference, which may bear on the patentability of the present invention. In addition to possibly having some relevance to the question of patentability, these references, together with the detailed description to follow, may provide a better understanding and appreciation of the present invention.

Non-interactive development systems are known. For example, U.S. Pat. No. 5,194,905 granted on Mar. 16, 1993 to Grace T. Brewington and assigned to the same assignee as the instant application discloses color image creation using a plurality of non-interactive developer structures wherein the color is user selectable. Selection of a desired color establishes the duty cycle of each of a plurality of developer structures which, in turn, determines how much, if any, of each color toner is deposited on a particular image. The duty cycle of each developer structure may vary between zero and a predetermined maximum time which corresponds to the time it takes for an image area on a charge retentive surface to move through a development nip intermediate the charge retentive surface and one of the developer structures.

U.S. Pat. No. 5,012,299 granted to Sawamura et al on Apr. 30, 1991 discloses a color adjustment apparatus for a color copying machine including a touch-key for inputting color adjustment data which causes the values for exposure and main-charge outputs and development bias to be varied in accordance with a correction to be made.

U.S. Pat. No. 4,546,722 granted on Oct. 15, 1985 to Toda et al discloses a development apparatus having a toner carrying member and a piezoelectric vibrator for displacing toner from the toner carrying member and causing it to fly in a manner to avoid depositing toner onto a non-image area of an image bearing surface. Such an arrangement prevents degradation of the charged image for the purpose of image preservation. The apparatus avoids adverse influences upon the electrostatic latent image so as not to cause disturbance in the resulting image if applied in a multiple copy per exposure process to produce a plurality of copies. This apparatus is non-interactive from a latent electrostatic image preservation standpoint, but does not appear to be non-interactive from a developed toner image standpoint, and therefore, would seem to allow unwanted scavenging of multi-colored toner to occur. This apparatus seems to be designed to prevent degradation of the charged image for the purpose of latent image preservation and not for the purpose of preventing degradation of the toned image pattern.

U.S. Pat. No. 4,987,456 granted to Snelling et al on Jan. 22, 1991 relates to a resonator suitable for generating vibratory energy which is arranged in line contact with the back side of a charge retentive member bearing an image on a surface thereof, in an electrophotographic device, to uniformly apply vibratory energy to the charge retentive member. The resonator comprises a vacuum producing element, a vibrating member, and a seal arrangement. Where the vibratory energy is to be applied to the charge retentive surface, a vacuum is applied by the vacuum producing element to draw the surface into intimate engagement with the vibrating member, and edge seal arrangement. The invention has application to a transfer station of enhancing electrostatic transfer of toner from the charge retentive surface to a copy sheet, and to a cleaning station, where mechanical vibration of the surface will improve the release of residual toner remaining after transfer.

U.S. Pat. No. 5,255,059 granted on Oct. 19, 1993 to Kai et al an image forming apparatus incorporating a donor structure comprising a plurality of electrodes and a piezoelectric member. The donor structure may be in the form of a roll or a belt. In each embodiment disclosed, a phase shifted voltage is applied to the electrodes for the purpose of creating a waving action which is effective to transport toner particles form a sump to a development zone. Thus, while the toner is moved through acoustic action of the waving materials the donor structure itself is stationary.

U.S. Pat. No. 4,568,955 issued on Feb. 4, 1986 to Hosoya et al discloses a recording apparatus wherein a visible image based on image information is formed on an ordinary sheet by a developer. The recording apparatus comprises a donor roller spaced at a predetermined distance from and facing the ordinary sheet and carrying the developer thereon, a recording electrode and a signal source connected thereto, for propelling the developer on the developing roller to the ordinary sheet by generating an electric field between the ordinary sheet and the developing roller according to the image information, a plurality of mutually insulated electrodes provided on the developing roller and extending therefrom in one direction, an AC and a DC source are connected to the electrodes, for generating an alternating electric field between adjacent ones of the electrodes to cause oscillations of the developer found between the adjacent electrodes along electric lines of force therebetween to thereby liberate the developer from the developing roller thereby forming the toner particles into smoke in the vicinity of the donor roller and the sheet.

U.S. Pat. No. 5,010,367 granted to Dan A. Hays on Apr. 23, 1991 relates to a non-interactive or scavengeless development system for use in color imaging. To control the developability of lines and the degree of interaction between the toner and receiver, an AC voltage is applied between a donor roll and electrodes supported adjacent to the surface of said donor roll to enable efficient detachment of toner from the donor to form a toner cloud. An AC voltage applied between the donor roll assembly and an image receiver serves to position the cloud in close proximity to the image receiver for optimum development of lines and solid areas without scavenging a previously toned image.

U.S. Pat. No. 4,833,503 granted to Christopher Snelling on May 23, 1989 relates to a multi-color printer using a sonic toner release development system to provide either partial or full color copies with minimal degradation of developed toner patterns by subsequent over-development with additional colors and minimal back contamination of developer materials. Multiple scanning beams, each modulated in accordance with distinct color image signals, are scanned across the printer's photoreceptor at relatively widely separated points, there being buffer means provided to control timing of the different color image signals to assure registration of the color images with one another. Each color image is developed prior to scanning of the photoreceptor by the next succeeding beam. After developing of the last color image, the composite color image is transferred to a copy sheet. Development is accomplished by vibrating the surface of a toner carrying member thereby reducing the net force of adhesion of toner to the surface of the toner carrying member. By appropriately limiting the magnitude of vibration of the toner carrying member in this development system toner will be released from the surface only in those areas in proximity to image areas where toner deposition is actually desired. Thus, selective clouds of toner may be made to occur only in correspondence with those image areas that are actually to be developed by toner deposition onto them.

In the '503 patent, a piezoelectric belt is entrained about a plurality of support rollers, one of which supports a portion of the piezoelectric belt in a nip or development zone intermediate the belt and a substrate containing latent electrostatic images. An electrically biased, conductive roller supports the portion of the belt in the development zone. The biasing of the piezoelectric belt in the development zone creates acoustic activity in the belt which liberates toner particles allowing them to be attracted to the electrostatic images on the substrate. With the use of the conductive roller as in the '503 patent an extended zone of acoustic activity is created by virtue of the wrap angle of the belt relative to the conductive roller. With an extended zone of acoustic activity, pre-nip acoustic excitation occurs which is undesirable because it inhibits proper development.

BRIEF SUMMARY OF THE INVENTION

Briefly, in accordance with the present invention, a non-interactive development system which is particularly useful in a color printer is provided. The developer system of the present invention uses a piezoelectric donor member for presenting toner particles to latent electrostatic images to render them visible. A desired amount of toner is liberated from the donor member in a nip or development zone by virtue of acoustic vibration of the donor member which serves to release toner carried on the surface of the donor member.

Excess acoustic activity in a nip or development zone is avoided by fabricating the donor member in the form of an electroded roller. The electrodes of the donor roll are spaced about a circumference of the roller structure, either on the inside or on the outside. An electrical bias is applied to each electrode as it is rotates through the nip or development zone.

Any propagation of acoustic motion in the pre and post nip areas of the roll may be eliminated by active damping using phase shifted voltages to bias adjacent electrodes. Such propagation may also be eliminated using the acoustic damping properties of a dielectric support material in which the electrodes are embedded.

DETAILED DESCRIPTION OF THE PREFERRED EMBODIMENT OF THE INVENTION

This invention relates to an imaging system which is used to produce a color output in a single pass. It will be understood that it is not intended to limit the invention to the embodiment disclosed. On the contrary, it is intended to cover all alternatives, modifications and equivalents as may be included within the spirit and scope of the invention as defined by the appended claims.

Figure 3:
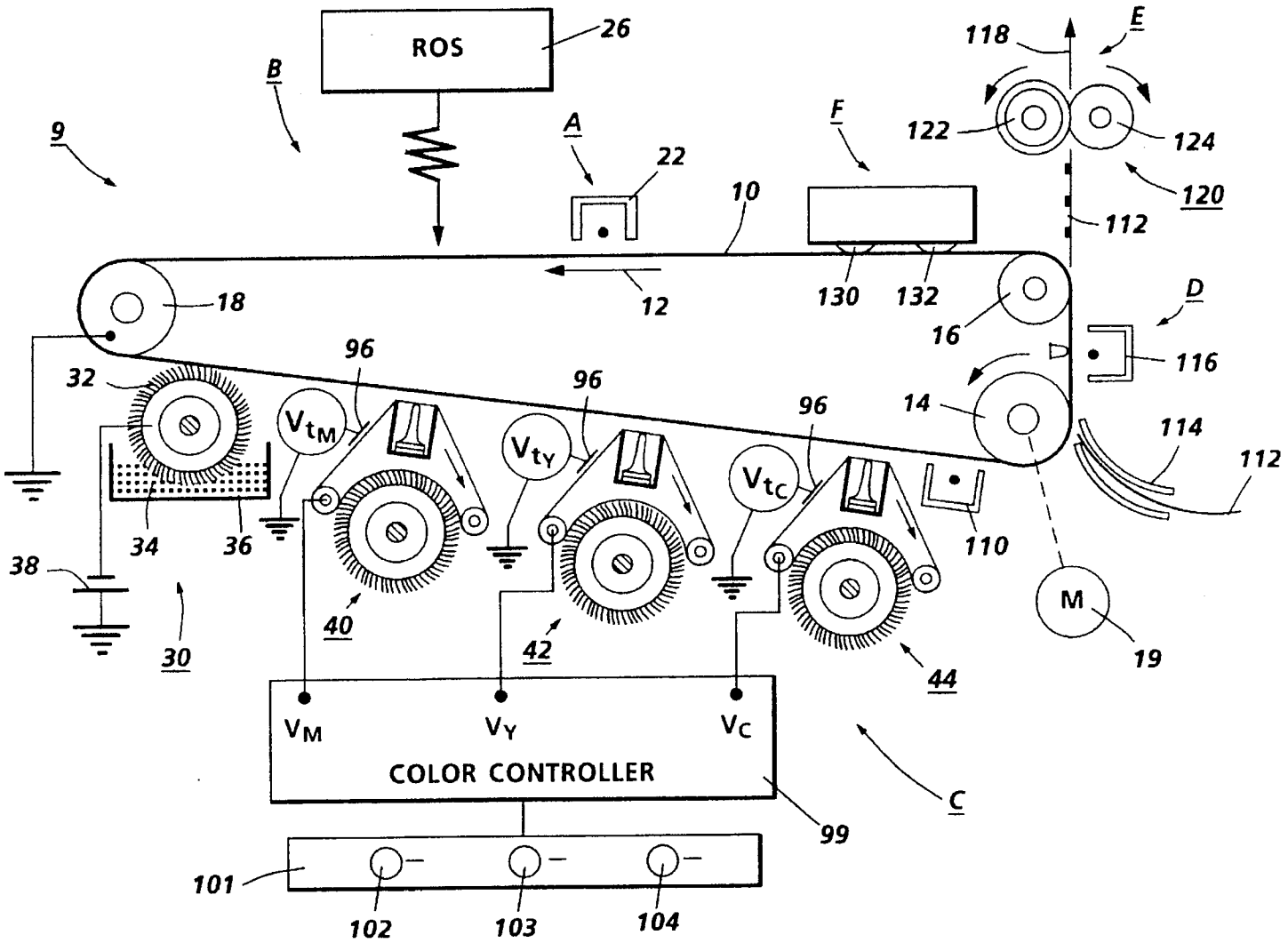
FIG. 3 is a schematic illustration of a prior art color imaging apparatus in which the invention may be utilized.

FIG. 3 schematically depicts the various components of an illustrative electrophotographic copying machine which may incorporate the sonic toner release development apparatus of the present invention therein.

As shown in FIG. 3, an electrophotographic printing machine 9 of the prior art in which the present invention may be utilized comprises a monopolar photoreceptor belt 10 having a photoconductive surface formed on a conductive substrate. Belt 10 moves in the direction indicated by arrow 12, advancing sequentially through the various xerographic process stations. The belt is entrained about a drive roller 14 and two tension rollers 16 and 18. The roller 14 is operatively connected to a drive motor 19 for effecting movement of the photoreceptor belt 10 in an endless path.

With continued reference to FIG. 3, a portion of belt 10 passes through charging station A where a corona generating device, indicated generally by the reference numeral 22, charges the photoconductive surface of belt 10 to a relative high, substantially uniform, negative potential.

Next, the uniformly charged portions of the photoreceptor surface are advanced through exposure station B. At exposure station B, the uniformly charged photoreceptor or charge retentive surface 10 is exposed to a laser based output scanning device 26 which causes the charge retentive surface to be discharged in accordance with the output from the scanning device. Preferably the scanning device is a three level laser Raster Output Scanner (ROS). Alternatively, the ROS could be replaced by a conventional xerographic exposure device.

The photoreceptor, which is initially charged to a voltage $V_0$, undergoes dark decay to a level $V_{ddp}$ equal to about −900 volts. When exposed at the exposure station B it is discharged to $V_c$ equal to about −100 volts which is near zero or ground potential in the highlight (i.e. color other than black) color parts of the image. The photoreceptor is also discharged to $V_w$ equal to approximately −500 volts imagewise in the background (white) image areas.

At development station C, a magnetic brush development system, indicated generally by the reference numeral 30 advances developer material into contact with the electrostatic latent images. The development system 30 comprises one or more magnetic brushes 32 and a supply of two-component developer 34 contained in a developer housing 36. The developer 34 comprises a mixture of carrier beads and black toner particles together with additives as needed for specific applications. Black toner particles which are positively charged are deposited on the charged area or CAD images of the tri-level images formed with the ROS. Magnetic brush development which is an interactive system is suitable for developing the CAD images because it is the first developer system. Thus, already developed images do not have to move past that developer housing. A suitable negative developer bias is applied to the developer system 30 via a DC power source 38.

The discharged area or DAD images, unlike the CAD image, are preferably developed using non-interactive development systems 40, 42 and 44 adapted to deposit varying amounts of color toner particles onto the DAD portion of the triolevel image. For, example these non-interactive developer systems may deposit negatively charged, magenta, yellow and cyan toners in a spot on spot manner on the DAD images. Each of the development systems 40, 42 and 44 is identical with the exception of the color toner which is deposited thereby. For a more detailed description of the developer structures 40–44, reference may be had to U.S. Pat. No. 5,305,070 (incorporated herein by reference) granted to Christopher Snelling on Apr. 14, 1994.

A color controller 99 (FIG. 3) and user interface (UI) 101 provide means for user selection of the final color for the DAD image. The UI comprises a plurality of control knobs 102, 103 and 104, one for each non-interactive development system. By reference to a color palette, not shown, the user can obtain the settings for the control knobs. For example, once a specific color is identified by the user the setting of these knobs determines the individual biases for the development systems.

Since the photoreceptor contains both positive and negative toner particles thereon, a pre-transfer corotron 110 is provided for effecting a unipolar image prior to transfer.

Referring again to FIG. 3, after the electrostatic latent image has been subjected to the pre-transfer corona emissions, the photoreceptor belt advances the toner powder images to transfer station D. A copy sheet 112 is advanced to transfer station D by sheet feeding apparatus, not shown. Preferably, sheet feeding apparatus includes a feed roll contacting the uppermost sheet of a stack of sheets. The feed roll rotates to advance the uppermost sheet from stack into chute 114. Chute 114 directs the advancing sheet of support material into contact with photoconductive surface of belt 10 in a timed sequence so that the toner powder images developed thereon contact the advancing sheet at transfer station D. Transfer station D includes a corona generating device 116 which sprays ions onto the back side of sheet 112. This attracts the toner powder image from photoconductive surface 10 to sheet 112. After transfer, sheet 112 continues to move in the direction of arrow 118 onto a conveyor (not shown) which advances sheet 112 to fusing station E.

Fusing station E includes a fuser assembly, indicated generally by the reference numeral 120, which permanently affixes the transferred powder image to sheet 112. Fuser assembly 120 includes a heated fuser roller 122 and back-up roller 124. Sheet 112 passes between fuser roller 122 and back-up roller 124 with the toner powder image contacting fuser roller 122. In this manner, the toner powder image is permanently affixed to sheet 112. After fusing, sheet 112 advances through a chute, not shown, to catch tray, also not shown, for subsequent removal from the printing machine by the operator.

After the copy sheet is separated from photoconductive surface of belt 10, the residual toner particles adhering to photoconductive surface of belt 10 are removed therefrom at cleaning station F. Cleaning station F may include a rotatably mounted fibrous brush, not shown, in contact with photoconductive surface. The particles are cleaned from photoconductive surface by the rotation of the brushes 130 and 132 in contact therewith. Subsequent to cleaning, a discharge lamp (not shown) floods the photoreceptor with light to dissipate any residual electrostatic charge remaining thereon prior to the charging thereof for the next successive imaging cycle.

Figure 1:
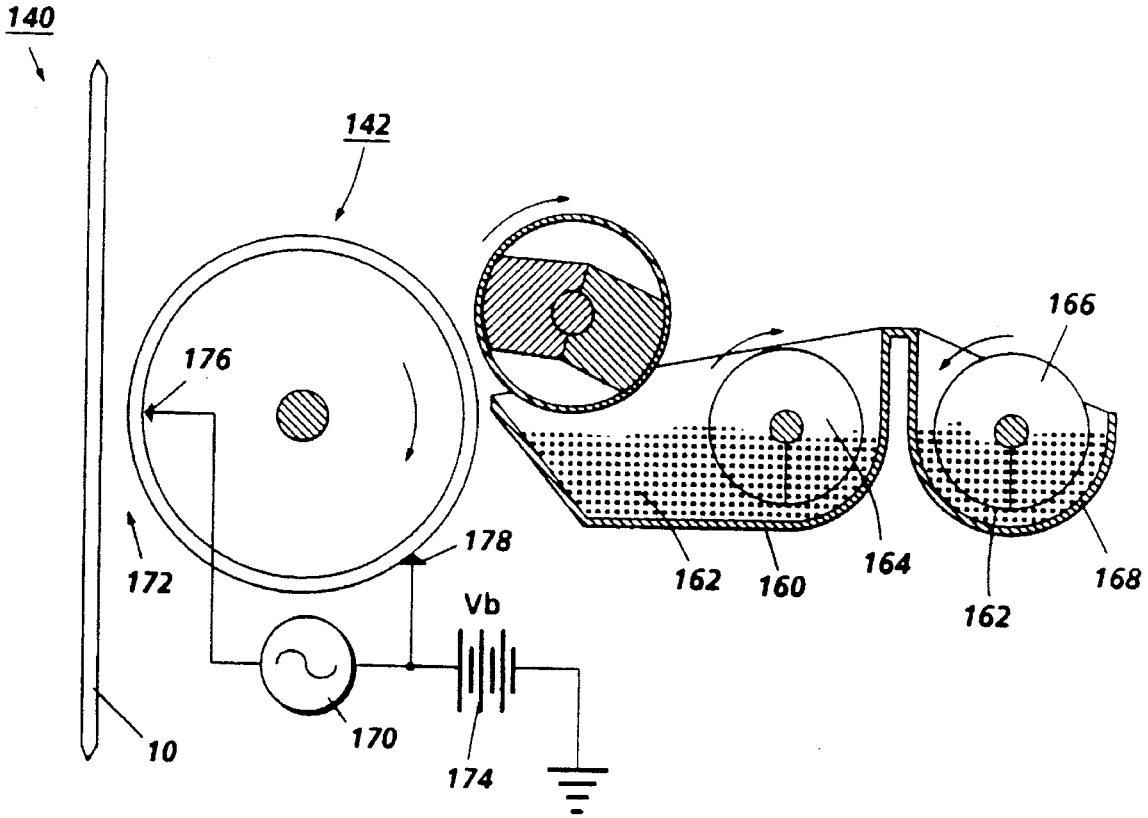
FIG. 1 is a schematic illustration of a developer structure according to the invention.
Figure 2:
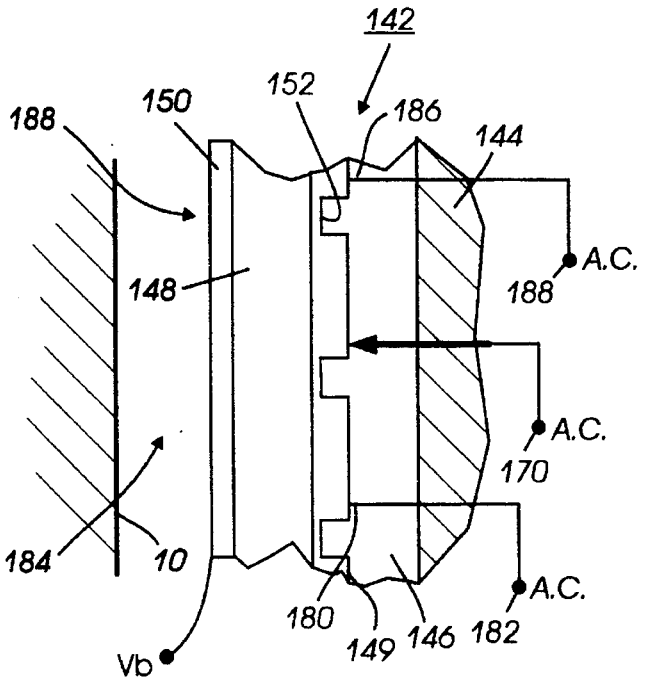
FIG. 2 shows an enlarged fragmentary view of a portion of a donor roll structure.

A non-interactive development system 140 according to the present invention is illustrated in FIGS. 1 and 2. As shown therein, the development system 140 comprises a donor roll structure 142. The donor structure comprises a rigid core 144 (FIG. 2), a dielectric support layer 146, a piezoelectric film 148, an outer conductive layer 150 and a plurality of electrodes 149.

In one contemplated embodiment of the invention the electrodes may be photofabricated on an inner surface 152 of the piezoelectric film or layer 148. The conductive outer layer 150 is adhered to the outer surface of the film 148. A semiconductive overlayer could be added to allow conductive magnetic brush loading of the surface with toner particles. The dielectric support 146 is attached to the side of the film containing the electrodes 149. The piezoelectric layer 148 may be fabricated from one of the following materials: PVDF (poly(vinylidene fluoride), PVDF copolymers a piezoelectric/polymer matrix.

Alternatively, the electrodes may be formed on the core 144. In this embodiment, the layer 148 and the outer conductive layer 150 may form a sleeve which is installed over the insulative core containing the electrodes. Preferably, a seamless sleeve of PVDF (poly(vinylidene fluoride) material is used but a seamed structure could be used by employing a donor/photoreceptor speed ratio appropriate to eliminate seam discontinuity effects on developed images.

It should be noted that with either method of fabrication an option exists, in that, poling of the piezoelectric film may be performed after, rather than before assembly of the donor roll structure. For details of PVDF film fabrication and processing reference may be had to "Production of ferroelectric polymer films", P. E. Bloomfield and M. A. Marcus, Chapter 3 of *The Applications of Ferroelectric Polymers* by T. T. Wang, J. M. Herbert and A. M. Glass, Blackie and Son Ltd., 1988.

The donor roll 142 is supported opposite the photoreceptor in a well known manner and is adjacent a developer sump 160 containing two component (i.e. carrier and toner) magnetic developer 162. A conventional magnetic brush structure 163 is provided for delivering toner particles to the surface of the donor structure. One of a pair of cross mixing augers 164 is operatively supported in the sump 160 while a second auger 166 is supported in a compartment 168 of the sump.

An AC power source 170 serves to apply a voltage to the electrodes 149 as they pass through a nip or development zone 172 intermediate the donor roll and the photoreceptor. A DC voltage is applied to the conductive outer layer 150 of the donor structure via a power source 174. The AC and DC voltages are applied using a pair of commutating brush structures 176 and 178. A commutating brush structure 180 is is positioned for contacting each of the electrodes 149 as the donor roll structure is rotated such that the electrodes 149 sequentially pass through the development zone 172. An AC phase shifted voltage provided by power source 182 is applied to an electrode 149 via the brush structure 180. The brush structure is positioned such that it contacts an electrode 149 in a pre-nip area 184. The phase shifted voltage serves to eliminate propagation of acoustic motion or excitation of the piezoelectric film 148 in in the pre-nip area. A commutating brush structure 186 is positioned such that it contacts an electrode 149 in a post-nip area 188. An AC phase shifted voltage provided by power source 188 is applied to the electrode 149 in the post-nip area via the brush 186. Thus, the excitation of the piezoelectric member or film 148 is confined to an area thereof that resides in the development zone thereby optimizing toner deposition on images on the photoreceptor.

While the donor structure 42 is disclosed in the form of a roll it will be appreciated that a belt construction is contemplated. The belt may be supported by a plurality of combination support/damping rolls.

What is claimed is:

1. A method of creating toner images, said method including the steps of:

moving an imaging member in an endless path;

forming latent electrostatic images on said imaging member;

moving a donor member comprising a piezoelectric member and an electrode structure in an endless path through a development zone and adjacent a supply of developer, said electrode structure comprising a plurality of electrodes;

supplying toner to an outer surface of said donor member for being transported to said development zone; and applying an AC bias voltage to one of said electrodes as it passes through said development zone such that an isolated area of said piezoelectric member is caused to acoustically vibrate for effecting release of toner from said donor member.

2. The method according to claim 1 wherein said step of moving a donor member comprises moving a donor roll.

3. The method according to claim 2 wherein said electrodes structure is formed on a insulative core forming a part of said donor roll.

4. The method according to claim 3 further including a step of preventing pre-nip excitation of said piezoelectric member thereby enhancing the creation of toner images.

5. Apparatus for creating toner images, said apparatus comprising:

an imaging member supported for movement in an endless path;

means for forming latent electrostatic images on said imaging member;

means for moving a donor member comprising a piezoelectric member and an electrode structure in an endless path through a development zone and adjacent a supply of developer, said electrode structure comprising a plurality of electrodes;

means for supplying toner to an outer surface of said donor member for being transported to said development zone; and means for applying a bias voltage to one of said electrodes as it passes through said development zone such that an isolated area of said piezoelectric member is caused to acoustically vibrate for effecting release of toner from said donor member.

6. Apparatus according to claim 5 wherein said means for moving a donor member comprises means for moving a donor roll.

7. Apparatus according to claim 6 wherein said electrodes are formed on a rigid core forming a part of said donor roll.

8. Apparatus according to claim 5 further comprising means for preventing pre-nip excitation of said piezoelectric member thereby enhancing the creation of toner images.

9. Apparatus according to claim 8 further comprising means for preventing post-nip excitation of said piezoelectric member thereby enhancing the creation of toner images.

10. Apparatus according to claim 9 wherein said means for preventing pre and post nip excitation comprises means for applying a phase shifted voltage to electrodes adjacent an electrode in said development zone and disposed in pre and post nip areas.

* * * * *